US007527063B1

(12) United States Patent
Chen

(10) Patent No.: US 7,527,063 B1
(45) Date of Patent: May 5, 2009

(54) RIB STRUCTURE OF AN UMBRELLA WITH TWO LAYERS OF UMBRELLA COVER

(76) Inventor: Hsia Hui Chen, 2F-1, No. 152, Nan Ya Street, Hsinchu City (TW)

( * ) Notice: Subject to any disclaimer, the term of this patent is extended or adjusted under 35 U.S.C. 154(b) by 0 days.

(21) Appl. No.: 12/068,874

(22) Filed: Feb. 13, 2008

(51) Int. Cl.
*A45B 25/22* (2006.01)

(52) U.S. Cl. ..... 135/27; 135/31; 135/33.4; 135/33.7

(58) Field of Classification Search ..... 135/23, 135/25.31, 25.32, 27, 29, 31–32, 33.7, 33.2, 135/33.4, 33.41
See application file for complete search history.

(56) References Cited

U.S. PATENT DOCUMENTS 5,078,166 A * 1/1992 Lee ..... 135/33.7
5,597,004 A * 1/1997 Okuda ..... 135/29
5,787,912 A * 8/1998 Wu ..... 135/29
6,024,109 A * 2/2000 Lin et al. ..... 135/33.7
6,039,063 A * 3/2000 Lin et al. ..... 135/33.7
6,089,244 A * 7/2000 Ko ..... 135/33.7
6,095,171 A * 8/2000 Lin et al. ..... 135/33.7
6,601,597 B2 * 8/2003 Sung ..... 135/33.7
6,681,784 B2 * 1/2004 Chou et al. ..... 135/33.7
7,415,986 B2 * 8/2008 Wu ..... 135/33.7
2007/0209691 A1 * 9/2007 Lin ..... 135/32

* cited by examiner

*Primary Examiner*—Winnie Yip
(74) *Attorney, Agent, or Firm*—Leong C. Lei

(57) ABSTRACT

A kind of rib structure in an umbrella with two layers of umbrella cover mainly uses a thinner metal bar to be bent and formed the sleeve rings and paralleled long and short skeletons, and circular rings are wrapped in the end of the long and short skeletons. The sleeve ring is used to be sleeve-set directly on the position close to the mounting seat of the last folded rib with rounded bar shape in the umbrella rib. A front edge of the upper layer umbrella cover is fix-mounted on the upper rib-mounting nest of umbrella, and its lower edge is mounted on the circular ring of the long skeleton by the silk wire. The front edge in the lower layer of umbrella cover is mounted on the circular ring of the short skeleton by the silk wire, and its lower edge is mounted on the ball tail of the last folded rib by the silk wire. The upper and lower layers of umbrella cover can be linked by this independent sleeve-set method without the need of change in original elements of the umbrella rib.

2 Claims, 6 Drawing Sheets

RIB STRUCTURE OF AN UMBRELLA WITH TWO LAYERS OF UMBRELLA COVER

BACKGROUND OF THE INVENTION

A so-called umbrella 1 with two layers of umbrella cover as indicated in FIG. 1 mainly is combined with an independent upper layer umbrella cover 2 and a lower layer umbrella cover 3 to discharge the strong wind from their clearance and disperse the wind pressure to prevent the possible damage to ribs of said umbrella. The rib structure of a known umbrella 1 with two layers of umbrella cover (as described in U.S. Pat. No. 6,681,784) is set with a wind resisting rib 600 that is combined of a thinner metal bar with a ball tail 601 in one and with another end bent downwards to form the first circular ring 602 then extended a shorter bar toward the ball tail 601 and formed the second circular ring 603. As indicated in FIG. 2, a front edge of the upper umbrella cover 10 is mounted on the rib connecting nest 700 of the umbrella. A rear edge is mounted on the ball tail 601 of the wind resisting rib 600 by a silk wire, and is mounted with the first circular ring 602 by a silk wire as well. Furthermore, a front edge of the lower umbrella cover 20 is mounted on the second ring 603 by a silk wire, and a rear edge is mounted on the ball tail of the last folded rib 300 to form an umbrella with two layers of umbrella cover. However, this kind of structure can obviously be realized that said wind resisting rib 600 has no connection with the ribs of the umbrella. Therefore the umbrella with two layers of umbrella cover will lose its winding resisting effects due to the random swing of the wind resisting rib along with the upper, lower umbrella cover 10, 20. As further indicated in FIG. 3, the said structure is mounted a first circular ring 602 in the wind resisting rib 600 on the rivet 312 of an assembling seat 310 of a last folded rib 300 of the umbrella rib. Although this kind of set up can position the wind resisting rib 600, it will also cause the problems of cost increase owing to the necessity of removing the rivets.

SUMMARY OF THE INVENTION

The present invention is to provide a kind of rib structure in an umbrella with two layers of umbrella cover. The said structure mainly is a metal bar to be bent and formed the sleeve rings and paralleled long and short skeletons. The sleeve ring is used to be sleeve-set directly on the position close to the mounting seat of the last folded rib with rounded bar shape in the umbrella rib to let a lower edge of the upper layer umbrella cover be mounted on the circular ring of the long skeleton. The front edge in the lower layer umbrella cover is mounted on the circular ring of the short skeleton, and its lower edge is mounted on the ball tail of the last folded rib. The upper and lower layers of umbrella cover can be linked by this independent sleeve-set method without the need of change in original elements of the umbrella rib. The structures of the present invention will be described hereafter by referring to the following drawings.

DETAILED DESCRIPTION OF THE PREFERRED EMBODIMENT

Figure 1:
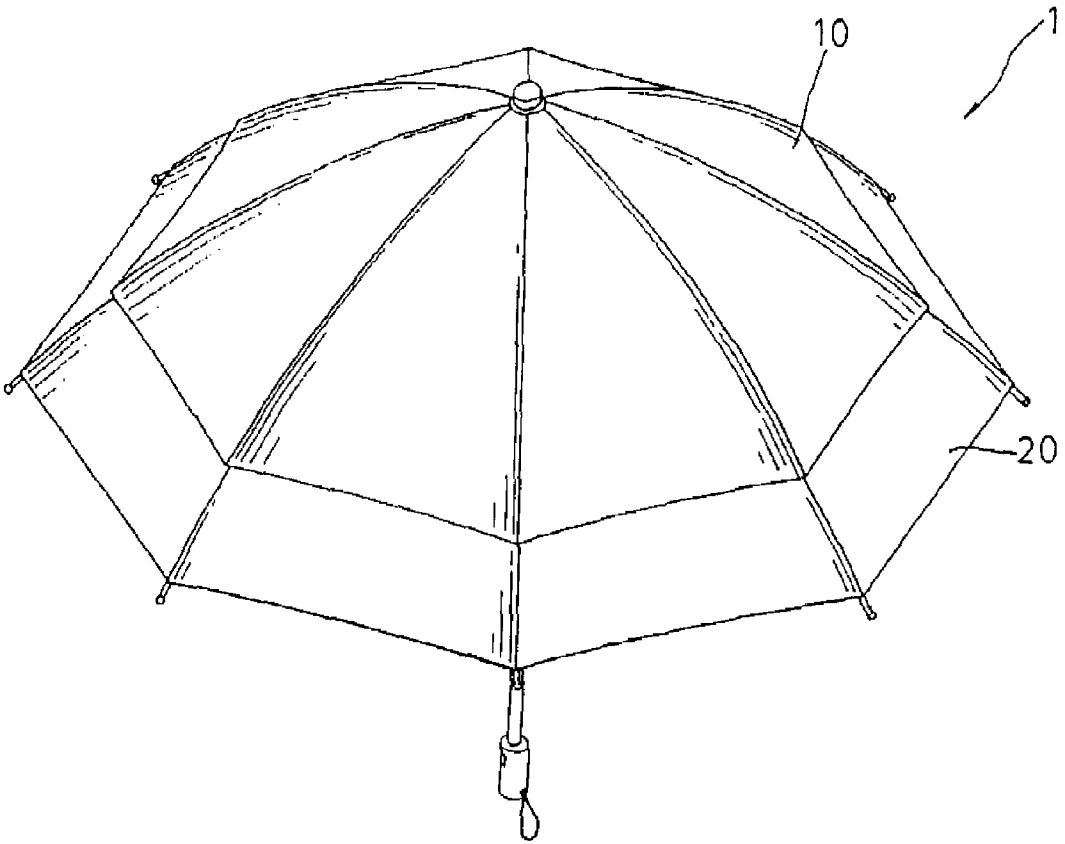
FIG. 1 PRIOR ART
FIG. 1 is an outside appearance diagram of a normal umbrella with two layers of umbrella cover.
Figure 2:
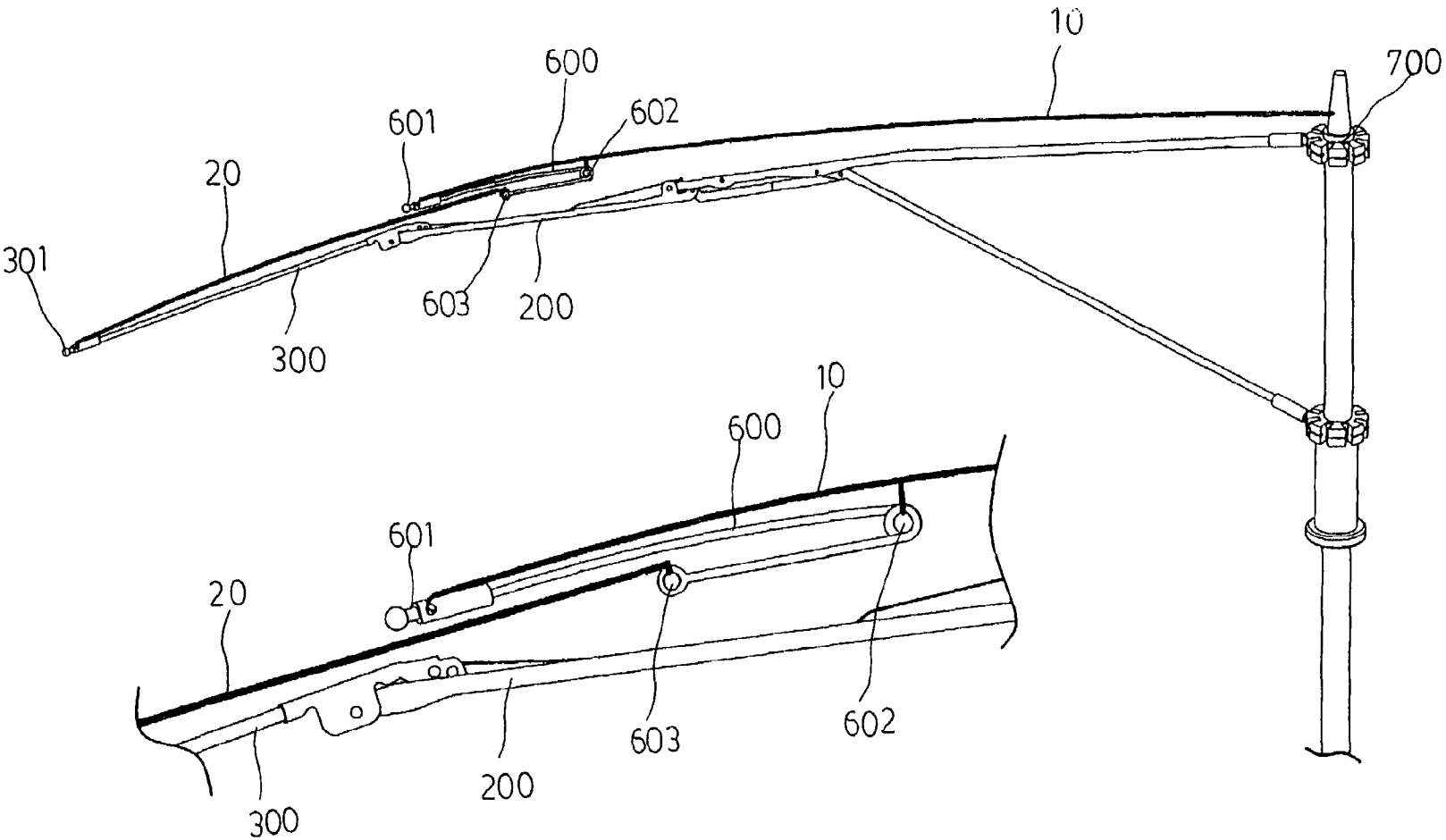
FIG. 2 (prior art)
FIGS. 2 and 3 are diagrams of the rib structure in the known umbrella with two layers of umbrella cover and its partial enlargement view.
Figure 3:
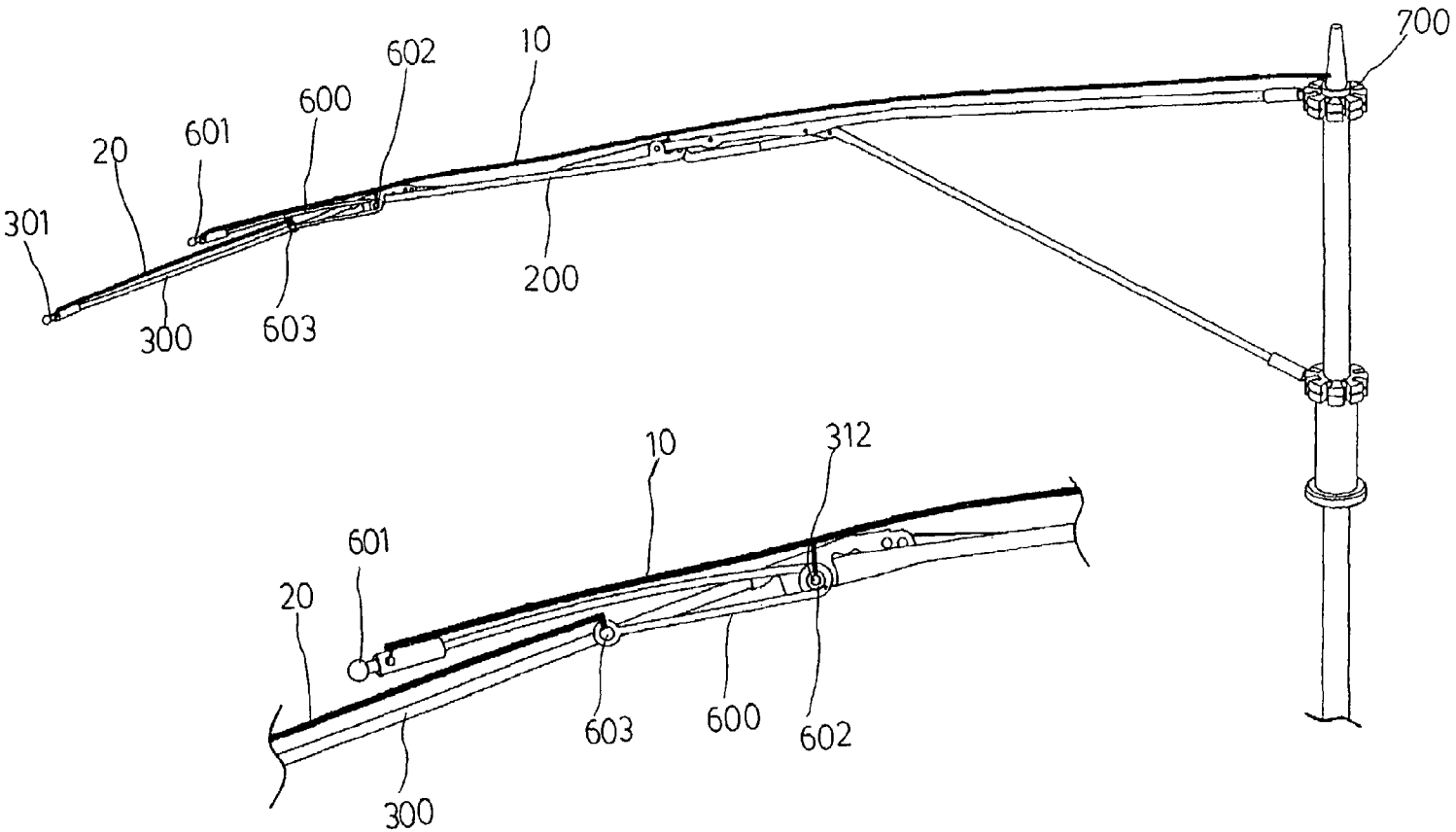
FIG. 3 (prior art)
Figure 4:
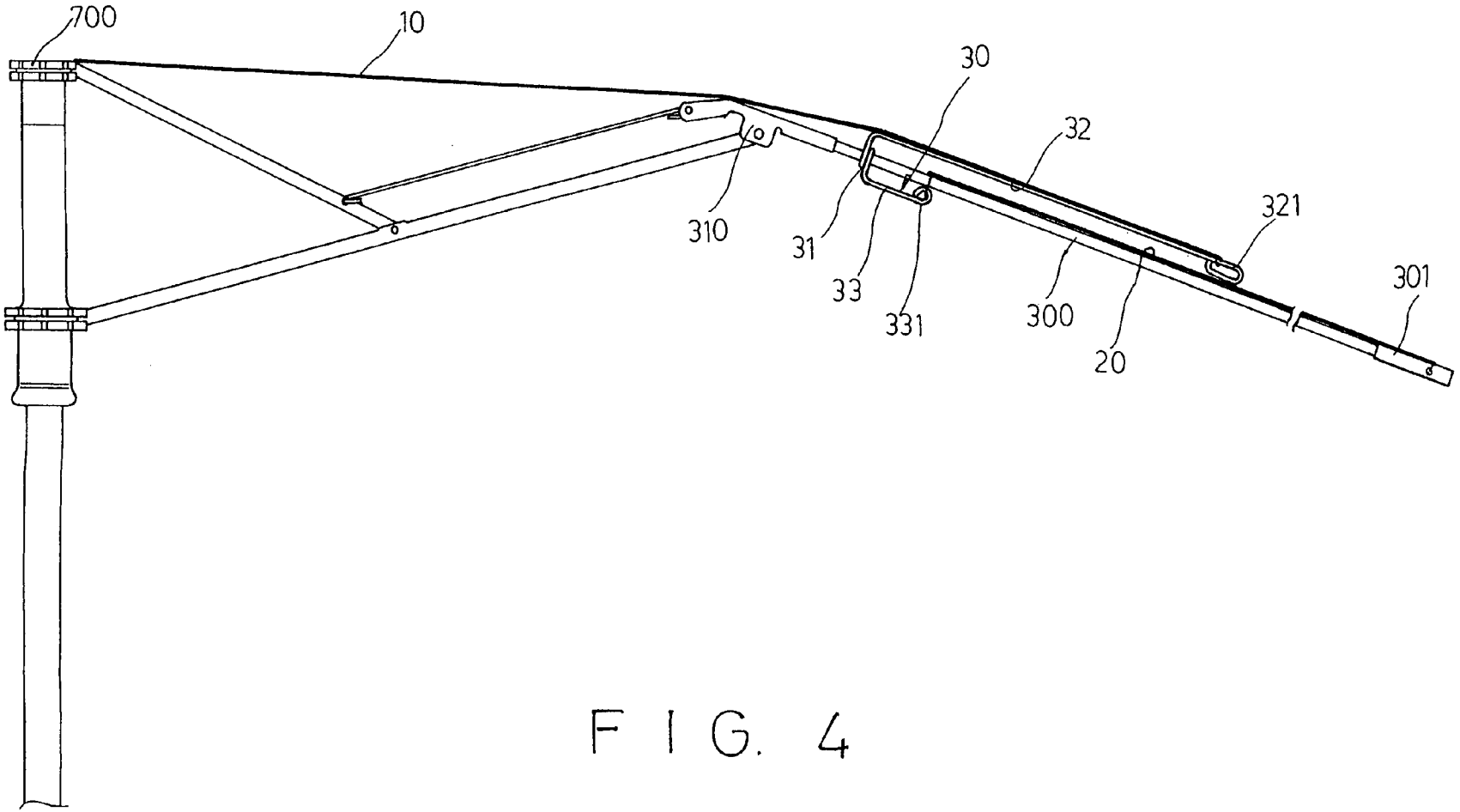
FIG. 4 is an assembly diagram of the rib structure of the present invention in an umbrella with two layers of umbrella cover.
Figure 5:
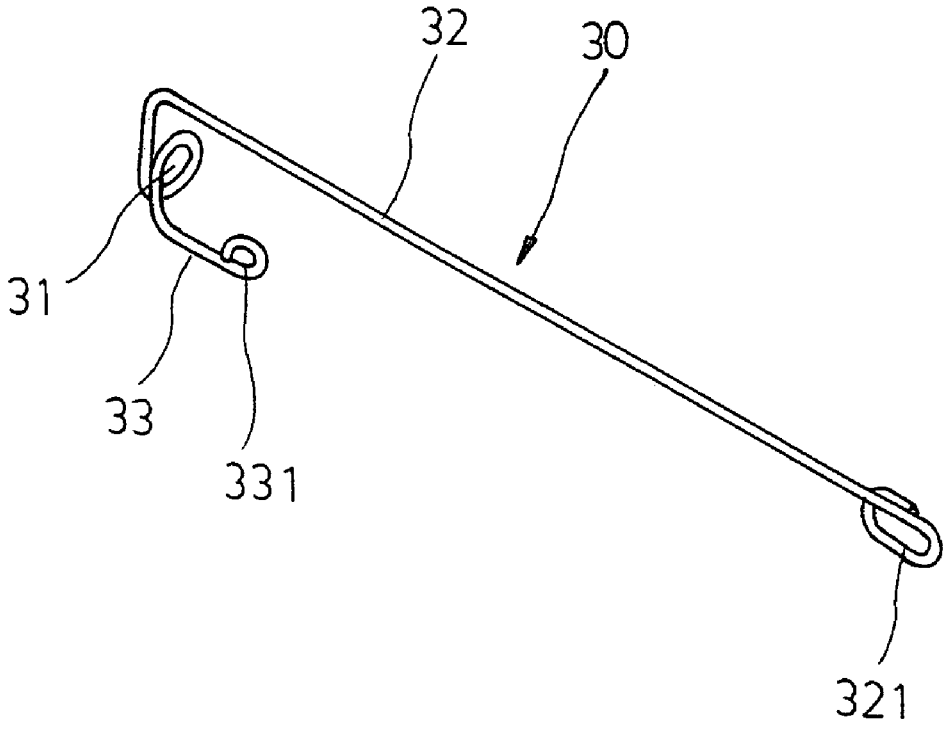
FIG. 5 is a three dimensional outside appearance diagram of the rib structure of the present invention in an umbrella with two layers of umbrella cover according to the present invention.

Please refer to those shown in FIGS. 4 and 5. The feature of the present invention is the structural form of a wind resisting rib 30. The said wind resisting rib 30 is combined of a thinner metal bar bent to form a sleeve ring 31 with its one end bent upwards and backwards to form a long skeleton 32 and wrapped to form a circular ring 321 in the skeleton's end, and with its other end bent downwards and backwards to form a short skeleton 33 thus also bent to form a circular ring 331 in the skeleton's end. Sleeve rings 31 are used to sleeve-set the wind resisting rib 30 on the last folded rib 300 of the umbrella rib close to the position of the assembling seat 310. A front edge of the upper layer of umbrella cover 10 is mounted on the rib-mounting nest 700 of the upper rib in the umbrella, and its end edge is mounted on the circular ring 321 of the long skeleton 32 in the wind resisting rib 30 by the silk wire. Furthermore, the front edge in the lower layer umbrella cover 20 is mounted on the circular ring 331 of the short skeleton 33 in the wind resisting rib 30 by the silk wire, and its end edge is mounted on the ball tail 301 of the last folded rib 300 by a silk wire.

By the aforementioned method, the assembly operations of the umbrella with upper and lower layers of umbrella cover are accomplished. Therefore, the biggest advantage of the present invention is that the wind resisting rib 30 is directly sleeve-set on the last folded rib of the umbrella ribs in an umbrella. Thus, a traditional umbrella with single layer of cover can also be utilized without the need of disassembling the other elements to cope with. The complexity of the assembly can be reduced and the manufacturing cost can be reduced.

Figure 6:
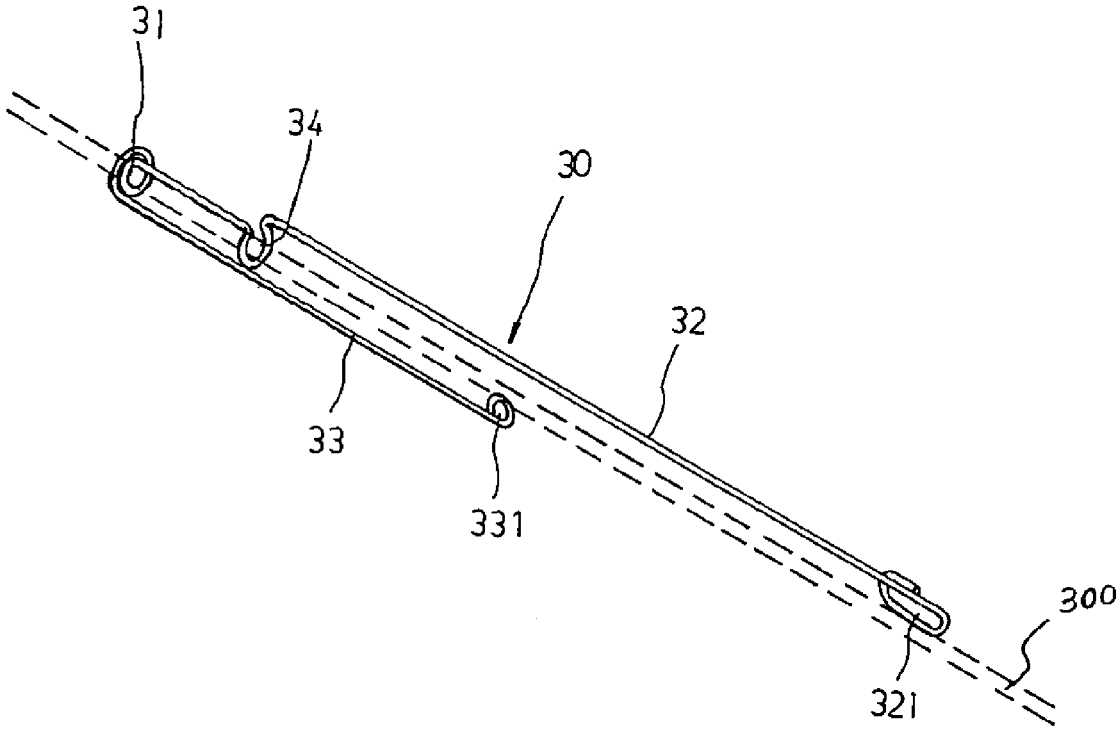
FIG. 6 is a three dimensional outside appearance diagram of the wind resisting rib of another embodiment of the present invention.

While a preferred embodiment of the invention has been shown and described in detail, it will be readily understood and appreciated that numerous omissions, changes and additions may be made without departing from the spirit and scope of the invention. Please refer to another embodiment of the present invention shown in FIG. 6. An auxiliary sleeve ring 34 mainly is formed at the position close to a sleeve ring 31 in the long skeleton 32 of the wind resisting rib 30 to have the sleeve ring 31 and the auxiliary sleeve ring 34 to be sleeve-set on the last folded rib 300 in the umbrella rib of an umbrella, thus the linking stability of the wind resisting rib 30 is increased to improve its effects. That is the about mentioned embodiment is only exemplary and is not to limit the scope of the invention. Any modification with the same merit will be still claimed in the present invention.

I claim:

1. A rib structure of an umbrella comprising an upper and lower layers of umbrella cover, an umbrella rib having a last folded rib, and a wind resisting rib, the improvement wherein said wind resisting rib has a metal bar bent to form a sleeve ring fitted over said last folded rib, said sleeve having a first end bent upwards and backwards to form a long skeleton and a second end bent downwards and backwards to form a short skeleton, said last folded rib passed through said sleeve ring said long skeleton having an end bent to form a circular ring bearing against an upper side of said last folded rib, said short skeleton having an end bent into a circular ring bearing against a lower side of said last folded rib, said upper layer umbrella cover mounted on the long skeleton and having an outer edge being connected to said circular ring of said long skeleton, and said lower layer umbrella cover mounted on said last folded rib and having a first end connected with a ball tail of said last folded rib by a silk wire and a second end connected with said circular ring of said short skeleton by a silk wire.

2. The rib structure of an umbrella as claimed in claim 1, wherein said long skeleton of said wind resisting rib is bent to form an auxiliary sleeve ring close to said sleeve ring and fitted over said last folded rib.

* * * * *